US012024679B2

(12) United States Patent
Van Der Ree

(10) Patent No.: US 12,024,679 B2
(45) Date of Patent: Jul. 2, 2024

(54) CRACKING LONG CHAINED HYDROCARBONS FROM PLASTIC-CONTAINING WASTE AND ORGANIC LIQUIDS

(71) Applicant: BLUEALP INNOVATIONS B.V., Groot-Ammers (NL)

(72) Inventor: Teunis Christiaan Van Der Ree, Groot-Ammers (NL)

(73) Assignee: BLUEALP INNOVATIONS B.V., Groot-Ammers (NL)

( * ) Notice: Subject to any disclaimer, the term of this patent is extended or adjusted under 35 U.S.C. 154(b) by 0 days.

(21) Appl. No.: 17/761,620

(22) PCT Filed: Sep. 18, 2020

(86) PCT No.: PCT/EP2020/076101
§ 371 (c)(1),
(2) Date: Mar. 18, 2022

(87) PCT Pub. No.: WO2021/053139
PCT Pub. Date: Mar. 25, 2021

(65) Prior Publication Data

US 2022/0403249 A1 Dec. 22, 2022

(30) Foreign Application Priority Data

Sep. 20, 2019 (NL) ..... 2023870

(51) Int. Cl.

| | |
|---|---|
| ***C10G 1/10*** | (2006.01) |
| ***C10G 1/00*** | (2006.01) |
| ***C10G 9/00*** | (2006.01) |
| ***C10G 47/32*** | (2006.01) |

(52) U.S. Cl.
CPC ..... *C10G 1/002* (2013.01); *C10G 1/10* (2013.01); *C10G 9/002* (2013.01); *C10G 47/32* (2013.01); *C10G 2300/1003* (2013.01); *C10G 2300/4006* (2013.01); *C10G 2300/80* (2013.01)

(58) Field of Classification Search
CPC ..... C10G 1/002; C10G 1/10; C10G 9/002; C10G 47/32; C10G 2300/1003; C10G 2300/80
See application file for complete search history.

(56) References Cited

U.S. PATENT DOCUMENTS

| | | | | |
|---|---|---|---|---|
| 5,580,443 | A | 12/1996 | Yoshida et al. | |
| 10,160,920 | B2 | 12/2018 | Rajagopalan et al. | |
| 2007/0227874 | A1 * | 10/2007 | Wolf-Eberhard | C10G 1/10 201/14 |
| 2018/0010050 | A1 * | 1/2018 | Van der Ree | C10G 7/00 |

FOREIGN PATENT DOCUMENTS

| | | | | |
|---|---|---|---|---|
| WO | 20130123377 | A1 | 8/2013 | |
| WO | 2016116114 | A1 | 7/2016 | |
| WO | WO-2016116114 | A1 * | 7/2016 | C10G 1/10 |
| WO | 201800050 | A1 | 1/2018 | |

OTHER PUBLICATIONS

Ahmad Imtiaz et al: "Pyrolysis Sutdy of Polypropylene and Polyethylene Into Premium Oil Products", International Journal of Green Energy, vol. 12, No. 7, Jan. 1, 2015 (Jan. 1, 2015), pp. 663-671.

Office Action issued by European Patent Office for European application No. 20771882.6 dated May 30, 2023.

* cited by examiner

*Primary Examiner* — Randy Boyer
(74) *Attorney, Agent, or Firm* — HOYNG ROKH MONEGIER B.V.; David P. Owen

(57) ABSTRACT

The invention provides a method for breaking down long chained hydrocarbons from plastic-containing waste and organic liquids based on crude oil, comprising providing material containing long-chained hydrocarbons; heating a specific volume of the material containing long-chained hydrocarbons to a cracking temperature, at which cracking temperature the chains of hydrocarbons in the material start cracking into shorter chains; and for the specific volume having a temperature above the cracking temperature, exposing the specific volume to heat which is less than or equal to 50° C. above the temperature of the specific volume. The invention also provides an apparatus for carrying out the invention.

18 Claims, 2 Drawing Sheets

CRACKING LONG CHAINED HYDROCARBONS FROM PLASTIC-CONTAINING WASTE AND ORGANIC LIQUIDS

FIELD OF THE INVENTION

The invention generally refers to a method and an apparatus to process used plastics and polyolefins.

BACKGROUND OF THE INVENTION

While untreated used plastics have been experienced to pose problems for the environment, they also provide a resource to at least partially replace hydrocarbons usually recovered from crude oil and other fossil fuel sources. When using used plastics as a resource, the known processes very often produce relatively large amounts of soot, that is heavy hydrocarbons and/or solid carbons, which are less sought after, while light hydrocarbons with shorter chain lengths are much more desired in the industry.

WO 2016/116114 A1 relates to a method for recovering hydrocarbons from plastic wastes, in particular polyolefin-rich waste, by means of purely thermolytic cracking without the use of catalysts, comprising melting the plastic waste in two heating devices, wherein a recycle stream derived from the cracking reactor and purified in a separator system is admixed with the molten plastic waste from the heating device. The mixed plastic stream is further heated in the second heating device, and from there is guided into the cracking reactor, where the plastic materials are cracked, and by means of subsequent distillation are separated into diesel and low boilers.

U.S. Pat. No. 10,160,920 B2 describes a sequential cracking process for the thermal cracking of a hydrocarbon feedstock in a cascade of cracking units wherein said hydrocarbon feedstock is heated in a furnace to a predetermined maximum temperature and thermally cracked in the cascade of cracking, such that the formation of coke is reduced.

BRIEF DESCRIPTION OF THE FIGURES

The figures are not to scale.

DESCRIPTION OF THE PREFERRED EMBODIMENTS

Figure 1:
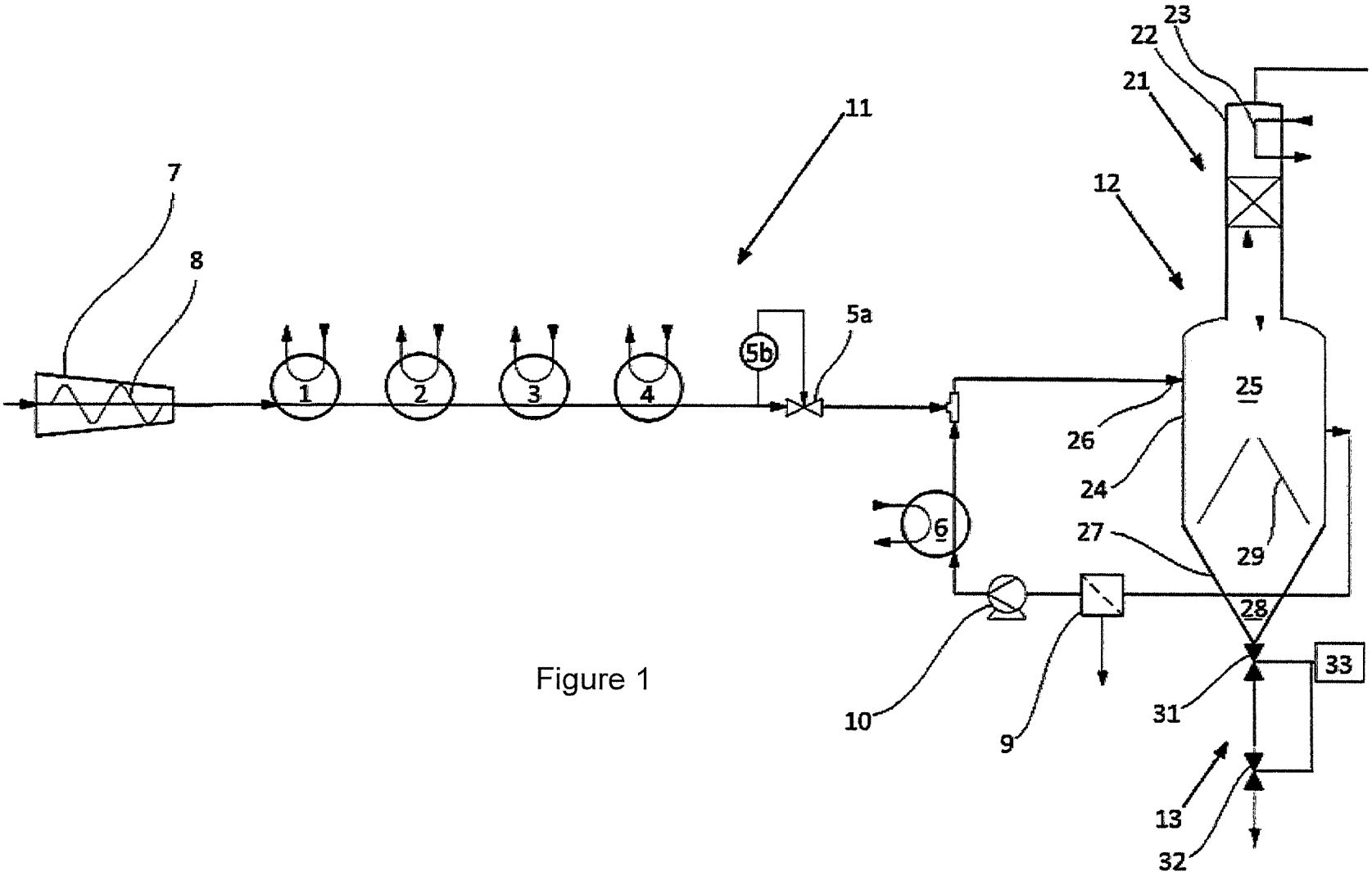
FIG. 1 shows an assembly for cracking long chained hydrocarbons.

FIG. 1 shows an assembly 10 for cracking long chained hydrocarbons according to an embodiment of the invention. Before further describing details of the depicted embodiment, general aspects of the invention are laid out below.

According to a first aspect a method for breaking down long chained hydrocarbons from plastic-containing waste and organic liquids based on crude oil comprises

- providing material containing long-chained hydrocarbons;
- heating a specific volume of the material containing long-chained hydrocarbons to a cracking temperature, at which cracking temperature the chains of hydrocarbons in the material start cracking into shorter chains; and
- for the specific volume having a temperature above the cracking temperature, exposing the specific volume to heat which is less than or equal to 50° C. above the temperature of the specific volume.

It has been found that by exposing the material containing long-chained hydrocarbons to less than 50° C. above the temperature that material, formation of solid carbons, soot and less useful heavy hydrocarbons is substantially reduced. Usually, exposing the specific volume will take place in a heating zone. While the description in the following will refer to a specific volume, it is to be understood that this is a specific volume of the material containing long-chained hydrocarbons that undergoes the cracking process and consequently changes to material containing the more short chained hydrocarbons the further it is progressed in the cracking process. Further, the method is to be considered as a continuous process having different grades of cracked material at the same point in time. Within the context of this application, cracking refers to breaking up longer chains or more complex structures of hydrocarbons into shorter chains or less complex structures of hydrocarbons usually by breaking carbon-carbon bonds.

In some embodiments while exposing, a pressure of the specific volume of the material containing long-chained hydrocarbons is adjusted to limit a gas content. As the material containing long-chained hydrocarbons is forwarded through a heating zone usually by means of a pump or extruder such as a screw auger arranged before the heating zone, it can be enough to arrange a pressure control valve after the heating structure that chokes the material flow and thus provides for a pressure build up inside the heating zone. Gas conventionally has a lower heat conductivity than liquids of the same substance. Higher pressures increase a boiling point of liquids. Accordingly, by increasing the pressure, heat conductivity inside the substance is increased such that heat transfer into the substance, here the material containing long-chained hydrocarbons is improved.

In some embodiments while exposing, the pressure of the material containing long-chained hydrocarbons is adjusted at between 10 and 35 bar, preferably at 20 bar. The proposed range provides a good trade-off between the improved heat conductivity and a tendency of the material containing long-chained hydrocarbons to crack.

In some embodiments an additive is provided while heating the material until it is sufficiently flowable, the additive preferably being an antioxidant, the additive particularly provided to donate a hydride to a chain end after cracking a long-chained polymer, the additive preferably containing butylated hydroxytoluene (BHT) and/or zeolite. It is thus not necessary to introduce the additive when the material containing long-chained hydrocarbons is under increased pressure already. Additionally, when introduced early, the additive is mixed well with the material containing long-chained hydrocarbons once it is about to crack.

In some embodiments the method further comprises lowering a pressure of the material after having exposed the specific volume to heat. That is, once the material containing long-chained hydrocarbons is not further heated, the shorter chained material can evaporate as a gas.

In some embodiments the method further comprises after having exposed the specific volume to heat, adjusting a temperature of the specific volume to adjust the type of gas evaporating from the specific volume. The type of gas in this context particularly refers to the number of carbons contained in one molecule of that gas.

In some embodiments the temperature is adjusted by cooling the specific volume. Cooling the specific volume will usually keep molecules with longer chains in the liquid state such that they do not evaporate so easily.

In some embodiments evaporated gas passes a partial condenser, the partial condenser being configured to separate long-chained hydrocarbons from the gas. The specific volume of the material after having been exposed to heat thus is allowed to separate, e.g. in a separation structure. The partial condenser particularly avoids that small droplets of long-chained hydrocarbons leave the separation structure together with the gas.

In some embodiments the specific volume after having evaporated gas is reheated to crack remaining long-chained hydrocarbons, preferably by less than 25° C. above the temperature of the material prior to reheating, and the reheated material is mixed with the material having been exposed to heat for the first time, the mixing ratio of reheated material to further material having been exposed to heat for the first time preferably is between 5:1 and 15:1, more preferably between 8:1 and 10:1. Reheating is thus carried out in a type of feedback loop for the material that has not cracked sufficiently, yet. That is when material comes from the heating zone into the separation structure, the gas evaporates and the remaining material containing long-chained hydrocarbons are fed back to be heated again and thus allow long chains to crack. The remaining material then is fed into the first time exposed material to again enter the separation structure and allow gas to evaporate.

In some embodiments the method further comprises separating coke from the specific volume after having exposed the specific volume to heat.

In some embodiments the specific volume enters a separator vessel after having exposed the specific volume to heat, where gas evaporates preferably via a partial condenser, and coke is separated via an outlet structure, the outlet structure preferably maintaining a minimum level of liquid material inside the separator vessel while having an opening of the separator tank to the outlet structure below the minimum level of liquid material.

In some embodiments the outlet structure comprises a lock either opening towards the separator vessel to separate coke or blocking the outlet structure from the separator vessel to release the coke in the lock.

In some embodiments the outlet structure comprises a valve and cooling structure maintaining the minimum level of liquid material inside the separator vessel and releasing the coke once the coke temperature has dropped below its combustion temperature.

In some embodiments the separator vessel provides a sedation zone adjacent to the opening of the separator tank to the outlet structure.

According to a second aspect an apparatus for carrying out the method according to any one of the embodiments above is provided.

According to a third aspect alternative or additional to the aspects listed above, a method for breaking down long chained hydrocarbons from plastic-containing waste and organic liquids based on crude oil comprises

- providing material containing long-chained hydrocarbons in a separation structure allowing short chained hydrocarbons to evaporate,
- circulating the material containing long-chained hydrocarbons from the separation structure and heating the material to a cracking temperature, at which cracking temperature the chains of hydrocarbons in the material start cracking into shorter chains in a heating zone separate from the separation structure,
- circulating the material into the separation structure.

The heating zone according to the foregoing aspect is separate from the separation structure as a volume of material being treated in the heating zone is outside the separation structure.

In an embodiment the heating zone separate from the separation structure adjusts a temperature of the material dependent on a volume of the material inside the separation structure. In some embodiments the heating zone separate from the separation structure adjusts a temperature of the material to adjust a cracking rate of the material. In some embodiments the cracking rate is a measure for cracking events per time frame. In further embodiments the cracking rate is a measure of cracking events per volume. By adjusting the cracking rate, the amount of short chained hydrocarbons is adjusted which in turn adjusts evaporation of the material, as cracked hydrocarbons generally have a lower evaporation temperature than the same hydrocarbons before cracking. Accordingly, by increasing the temperature of the material, evaporation in the material is promoted and the volume of the material increases. Consequently, increasing the temperature of the material raises a fill level of the material inside the separation structure.

In some embodiments the evaporated hydrocarbons are separated from the long chained hydrocarbons in the separation structure. In further embodiments the evaporated hydrocarbons are not circulated with the material containing long-chained hydrocarbons from the separation structure. Increasing the volume of material in the separation structure by increasing the evaporation of the material applies until the evaporated hydrocarbons are separated. As the specific volume of material in the gas phase is substantially larger than the specific volume of the same material in the liquid phase, the volume of the material in the separation structure can be adjusted across a large range by adjusting evaporation. In some embodiments hydrocarbons separated from the long chained hydrocarbons in the separation structure are replaced by material containing long chained hydrocarbons added to the material circulated from the heating zone separate from the separation structure prior to circulating into the separation structure.

According to a fourth aspect alternative or additional to the aspects listed above, a method for breaking down long chained hydrocarbons from plastic-containing waste and organic liquids based on crude oil comprises

- providing material containing long-chained hydrocarbons in a feeding device and heating the material inside the feeding device to a temperature at which flowability of the material increases,
- releasing the material into a heating structure and increasing the temperature of the material containing long-chained hydrocarbons to a cracking temperature, at which cracking temperature the chains of hydrocarbons in the material start cracking into shorter chains, wherein an additive supporting cracking is added to the material while the material is inside the feeding device.

The additive according to the foregoing aspect supports cracking by preventing recombination of cracked hydrocarbon chains. In some embodiments the additive provides a hydrogen atom to an open chain end after cracking. In some embodiments the additive is an anti-oxidant. In some embodiments the additive contains zeolite, calcium and/or butylated hydroxytoluene (BHT). It has been found that adding the additive in the feeding device is advantageous as adding such additive at a later stage might require additional measures such as pressurizing or heating the additive separately.

According to a fifth aspect alternative or additional to the aspects listed above, a method for breaking down long chained hydrocarbons from plastic-containing waste and organic liquids based on crude oil comprises providing material containing long-chained hydrocarbons;

heating a specific volume of the material containing long-chained hydrocarbons to a cracking temperature, at which cracking temperature the chains of hydrocarbons in the material start cracking into shorter chains; and maintaining a pressure of the specific volume of the material containing long-chained hydrocarbons to prevent evaporation while the material is heated.

Maintaining the pressure according to the foregoing aspect includes maintaining the pressure above atmospheric pressure, for example between 10 bar and 40 bar. In some embodiments the pressure is maintained at around 20 bar. The proposed range provides a good trade-off between an improved heat conductivity from a heat exchanger into the material containing long chained hydrocarbons and a tendency of the material to crack.

According to a sixth aspect alternative or additional to the aspects listed above, an apparatus for breaking down long chained hydrocarbons from plastic-containing waste and organic liquids based on crude oil comprises a heating structure configured to heat a specific volume of the material containing long-chained hydrocarbons to a cracking temperature, at which cracking temperature the chains of hydrocarbons in the material start cracking into shorter chains; and a back pressure control element configured to maintain a pressure of the specific volume of the material containing long-chained hydrocarbons to prevent evaporation while the material is heated, wherein the back pressure control element is arranged at an output of the heating structure.

An embodiment according to the foregoing aspect includes a feeding device configured to prevent pressure release therethrough, such as an extruder. In some embodiments the back pressure control element comprises a valve and/or a pressure sensor configured to adjust the pressure inside the heating structure.

According to a seventh aspect alternative or additional to the aspects listed above, a method for removing heavy hydrocarbons and solid carbon from a volume containing hydrocarbons of different chain lengths, comprises providing the volume containing hydrocarbons in a separation structure, creating a vortex around a vertical axis in the volume containing hydrocarbons, and drawing hydrocarbons from a bottom portion of the volume and conducting the drawn hydrocarbons into a lock chamber, the lock chamber extending between similar height levels as the volume containing hydrocarbons inside the separation structure, wherein, while drawing, the lock chamber is in fluid communication with the separation structure, and subjecting a top portion of the separation structure including the upper surface of the volume and a top portion of the lock chamber to the same fluid pressure.

In some embodiments, the lock chamber being in fluid communication with the separation structure, and subjecting a top portion of the separation structure and a top portion of the lock chamber to the same fluid pressure allows the lock chamber to fill under the pressure from the liquid inside the separation structure essentially leaving the filling to the effect of gravity. In some embodiments the hydrocarbons cool off prior to being released to following containers or to open air. In some embodiments the vortex is created by forwarding hydrocarbon containing material in a tangential direction into the volume.

According to an eighth aspect alternative or additional to the aspects listed above, an apparatus for removing heavy hydrocarbons and solid carbon from a volume containing hydrocarbons of different chain lengths, comprises a separation structure configured to contain hydrocarbons, the separation structure being configured to create a vortex around a vertical axis in volume containing hydrocarbons inside the separation structure, and a lock chamber configured to receive hydrocarbons from a bottom portion of the separation structure and extending between similar height levels as the separation structure, wherein the lock chamber is configured to be in fluid communication with the separation structure when receiving hydrocarbons, and wherein a top portion of the separation structure and a top portion of the lock chamber are configured to be at the same fluid pressure when receiving hydrocarbons.

In some embodiments the lock chamber is configured to allow the hydrocarbons to cool off prior to being released to following containers or to open air.

Coming back to the description of FIG. 1, the assembly 10 comprises a heating structure 11 and a separation structure 12. The heating structure 11 is in communication with the separation structure 12 to feed fluids into the separation structure 12. Particularly, the heating structure 11 feeds fluids containing cracked hydrocarbons into the separation structure 12.

In some embodiments a feeding device 7 is arranged to fill material containing long chained hydrocarbons such as waste plastic or crude oil into the heating structure 11. In various embodiments the feeding device comprises a component for storing and/or a component for breaking up any solid material exceeding a predetermined size. In some embodiments the predetermined size is around 100 mm or around 50 mm. In some embodiments the feeding device comprises an effector 8 for heating and/or forwarding the material containing long chained hydrocarbons. In some embodiments the effector is a screw auger 8 arranged to heat and/or forward the material containing long chained hydrocarbons. In some embodiments the screw auger moves 8 the material and internal friction in the material causes the material to heat up and to melt. In further embodiments the feeding device 7 comprises a heating device such as an electrical heater or a heating device perfused by a heating medium such as thermal oil. In various embodiments heating causes water to evaporate. In various embodiments the feeding device 7 comprises a pump such as a liquid ring pump to remove the water and/or halogens via degassing. The feeding device 7 forwards the material containing long chained hydrocarbons to the heating structure 11.

In some embodiments an additive increasing and/or optimizing cracking is inserted into the material in the feeding device 7. It has been found that inserting the additive in the feeding device 7 already allows for a more even distribution of the additive with the material. Also, even though the additive will only be active at a later stage, inserting the additive at the feeding device 7 avoids structures otherwise required to insert the additive into the material under increased pressure and heat. In some embodiments the additive is an anti-oxidant. In some embodiments the additive contains zeolite, calcium and/or butylated hydroxytoluene (BHT). In various embodiments the additive prevents that cracked hydrocarbon chains recombine. In further embodiments the additive binds disturbances such as chlorine.

The heating structure 11 receives the material containing long chained hydrocarbons. In various embodiments the heating structure comprises at least one heating zone 1, 2, 3, 4. The heating zone 1, 2, 3, 4 is arranged to expose the material containing long chained hydrocarbons to a limited temperature increase. Said differently, the material containing long chained hydrocarbons is exposed to a temperature that is less than a predetermined temperature above the temperature of the material. It has been found that by limiting a temperature increase, a yield of usable material containing hydrocarbons having desired chain lengths resulting from the operation of the assembly 10 is increased, and the amount of resulting solid carbons is limited. In various embodiments, the heating zone 1, 2, 3, 4 is arranged to expose the material containing long chained hydrocarbons to a predetermined temperature of around 50° C. or less.

In the following, the temperature to which the material containing long chained hydrocarbons is exposed will be referred to as exposure temperature. The exposure temperature will however have different values depending on the location in the assembly and the corresponding temperature of the material containing long chained hydrocarbons.

For example, for the material containing long chained hydrocarbons entering the heating zone 1, 2, 3, 4 and having a temperature of around 200° C., the heating zone 1, 2, 3, 4 exposes the material containing long chained hydrocarbons at the entrance of the heating zone 1, 2, 3, 4 to an exposure temperature of 250° C. or less. Once the material containing long chained hydrocarbons starts heating up, the heating zone 1, 2, 3, 4 exposes the material to exposure temperatures increased accordingly. For example, when the material containing long chained hydrocarbons has heated to a temperature of 250° C., the heating zone 1, 2, 3, 4, exposes the material to an exposure temperature of up to 300° C.

In various embodiments, the heating zone 1, 2, 3, 4 thus provides a batch process in which a batch of material containing long chained hydrocarbons is heated by no more than 50° C. above the temperature of the material until a predetermined maximum temperature is reached. After a predetermined holding time in which at least some long chained hydrocarbons crack, the material containing long chained hydrocarbons is released to an entity downstream of the assembly 10. In some embodiments there is no holding time, i.e. the holding time is close to nil, but the material is released immediately after heating.

In different embodiments the heating zone 1, 2, 3, 4 provides a flow path for the material containing long chained hydrocarbons. The heating zone 1, 2, 3, 4 continuously or gradually increases the exposure temperature along the flow path. In some embodiments, the heating zone 1, 2, 3, 4 provides a first tube for the material containing long chained hydrocarbons. The material generally flows through the first tube in a first direction. The heating zone 1, 2, 3, 4 further provides a second tube contacting the first tube along a substantial length of the heating zone 1, 2, 3, 4 such that heat can transfer from the inside of the second tube into the first tube. The second tube provides a flow path for a heating medium.

In some of these embodiments, the heating medium flows in a direction opposite to the first direction such that the material containing long chained hydrocarbons heats up along the flow in the first direction, while the heating medium cools down along the flow path in the second direction. In some of these embodiments the heating medium is controlled to have a temperature not more than 50° C. above a predetermined final temperature when entering the second tube along the heating zone 1, 2, 3, 4, and to have a temperature not more than 50° C. above a temperature of the material containing long chained hydrocarbons when entering the heating zone 1, 2, 3, 4. In some embodiments temperature, velocity and/or pressure of the heating medium in the second tube and/or the material containing long chained hydrocarbons in the first tube are controlled. In some embodiments the second tube is dimensioned such that the heating medium flowing at a predetermined velocity therethrough and having a predetermined starting velocity will have the predetermined temperature characteristics. In some embodiments the first tube extends coaxially inside the second tube.

In some embodiment the second tube extends coaxially inside the first tube. In some embodiments the second tube is wound around the first tube. In some embodiments the first tube is shaped in meanders inside the second tube and the first tube is arranged such that material containing long chained hydrocarbons enters the first tube on the side adjacent to the position where the heating medium exits the second tube, and the material exits the first tube on the side of the second tube adjacent to the position where the heating medium enters the second tube.

In some embodiments the heating zone 1, 2, 3, 4 comprises several heating sections, each heating section exposing the material containing long chained hydrocarbons to a predetermined temperature. The heating sections are configured such that the material containing long chained hydrocarbons flows consecutively through each of them. Each heating section exposes the material to a higher exposure temperature than a previous heating section. The heating sections are configured such that the exposure temperatures do not exceed 50° C. above the temperature of the material containing long chained hydrocarbons when entering the respective heating section.

In the embodiment of FIG. 1 the heating zone 1, 2, 3, 4 comprises four heating sections. For example, for the material containing long chained hydrocarbons entering a first heating section 1 and having a temperature of around 200° C., the heating section 1 exposes the material containing long chained hydrocarbons to a first exposure temperature of 250° C. or less. While the material containing long chained hydrocarbons flows through the first heating section 1, the material containing long chained hydrocarbons heats up and its temperature approaches the first exposure temperature. In some embodiments the first exposure temperature is between 200° C. and 370° C. In some embodiments the first exposure temperature is between 220° C. and 320° C. In some embodiments the first exposure temperature is about 250° C.

Whether cracking takes place inside the first heating section 1 depends, apart from the temperature, on the long-chained hydrocarbons contained in the material as well as other substances contained deliberately or incidentally in the material, and the pressure of the material. In some cases, cracking substantially does not take place at low temperatures such as between 200° C. and 250° C. as the further parameters do not promote cracking. In such cases the exposure temperature may be higher than 50° C. above the temperature of the material. In some embodiments the exposure temperature may be as high as 50° C. above the minimum temperature at which cracking substantially takes place.

When exiting the first heating section 1, the material passes to a second heating section 2 downstream of the first heating section 1. The second heating section 2 exposes the material containing long chained hydrocarbons to a higher exposure temperature than the first heating section 1, namely a second exposure temperature. The second exposure temperature does not exceed a temperature of 50° C. above the temperature of the material containing long chained hydrocarbons. In various embodiments the second exposure temperature is between 250° C. and 400° C. In some embodiments the second exposure temperature is between 270° C. and 370° C. In some embodiments the second exposure temperature is at about 300° C. The material containing long chained hydrocarbons flows through the second heating section 2 and heats up towards the second exposure temperature.

From the second heating section 2 the material containing long chained hydrocarbons passes to a third heating section 3 downstream of the second heating section 2. The third heating section 3 exposes the material to a third exposure temperature. The third exposure temperature is higher than the second exposure temperature. The third exposure temperature does not exceed a temperature of 50° C. above the temperature of the material. In various embodiments the third exposure temperature is between 300° C. and 400° C. In some embodiments the third exposure temperature is between 320° C. and 380° C. In some embodiments the third exposure temperature is about 370° C. The material containing long chained hydrocarbons flows through the third heating section 3 and heats up towards the third exposure temperature.

From the third heating section 3 the material containing long chained hydrocarbons passes to a fourth heating section 4 downstream of the third heating section 3. The fourth heating section 4 exposes the material to a fourth exposure temperature. The fourth exposure temperature does not exceed a temperature of 50° C. above the temperature of the material. The fourth exposure temperature essentially determines the maximum temperature for cracking of the long chained hydrocarbons. In some embodiments the fourth exposure temperature is between 350° C. and 450° C. In further embodiments, the fourth exposure temperature is between 380° C. and 420° C. The material containing long chained hydrocarbons flows through the fourth heating section 4 and heats up towards the fourth exposure temperature.

While the material containing long chained hydrocarbons flows through the fourth heating section 4, some of the long chained hydrocarbons are cracked. In some embodiments, some of the long chained hydrocarbons are cracked while the material flows through the third heating section 3. In some embodiments, some of the long chained hydrocarbons are cracked while the material flows through the second heating section 2. In some embodiments, some of the long chained hydrocarbons are cracked while the material flows through the first heating section 1. Principally the hotter a heating section is, the more cracking takes place. Once substantial amounts of long chained hydrocarbons are being cracked, the heating section limits the exposure temperature to a maximum of 50° C. above the temperature of the material. The material containing long chained hydrocarbons thus also contains cracked hydrocarbons. That is, a share of the hydrocarbons with shorter chain lengths is increased as compared to the material before entering the heating zone. The material exiting the fourth heating section 4 is passed to the separation structure 12.

In various embodiments the heating sections are comprised of identical structures such that only one type of heating section can be used for each position in the chain of heating sections. In various embodiments the heating sections are designed for heating up to a temperature of 450° C. In various embodiments the heating sections are designed for operational pressures between 0 bar and 40 bar. In various embodiments the heating sections are supplied with a thermal oil as a heating medium. In various embodiments the thermal oil is selected to have a boiling point above the operating temperatures of the heating sections and/or a solidification temperature below 40° C.

In some embodiments each of the first to third heating sections is arranged to only allow material to exit once it has reached a certain minimum temperature such that the exposure temperature of the following heating section does not exceed 50° C. above the temperature of the material entering that following heating section. Said differently, each of the first to third heating sections is arranged to only allow material to exit once it has reached a temperature less than 50° C. below the exposure temperature of the respective following heating section.

In further embodiments the throughput of the material containing long chained hydrocarbons is adjusted to ensure that the material exiting the first to fourth heating sections has reached a certain respective temperature. For the first to third heating sections that certain temperature is less than 50° C. below the exposure temperature of the respective following heating section. For the fourth heating section 4 the certain temperature is a predetermined maximum temperature.

For a heating structure having more or less heating sections the above applies correspondingly.

In some embodiments there is a back pressure control element 5*a*, 5*b* downstream of the heating zone 1, 2, 3, 4. The back pressure control element 5*a*, 5*b* is arranged to adjust a pressure of the material containing long chained hydrocarbons in the heating zone. In various embodiments the back pressure control element controls a throughput of the material through the heating zone. The back pressure control element is arranged between the heating zone and the separation structure 12. The material containing long chained hydrocarbons exiting the back pressure control element 5*a*, 5*b* is passed to the separation structure 12. In some embodiments the back pressure control element comprises an adjustable valve 5*a* and a pressure sensor 5*b*. The pressure sensor 5*b* is configured to detect a pressure of the material in the heating zone. The adjustable valve 5*a* is configured to release the material as long as the pressure sensor 5*b* detects a pressure in a specific range. In some embodiments the specific range is between 10 bar and 40 bar. In some embodiments the specific range is at around 20 bar. If the material in the heating zone has a pressure outside the range, the valve 5*a* controls a throughput of material. For example, if the pressure in the heating zone drops below a lower boundary of the pressure range, the valve 5*a* reduces a throughput until pressure in the heating zone builds up. If the pressure in the heating zone exceeds an upper boundary, the valve 5*a* allows for an increased throughput until the pressure drops. In some embodiments the valve 5*a* has a structure of a pressure relief valve, that is, the valve 5*a* is kept closed by a preloaded spring and opens towards the following separation structure 12 once a predetermined pressure is exceeded, while it closes once the pressure drops below a predetermined pressure. In further embodiments the valve 5*a* is a gate valve opening and closing to adjust a throughput and thereby the pressure as detected by the pressure sensor 5*b*. In some embodiments the valve 5*a* is arranged to allow a small throughput at all times, said differently, the valve 5*a* is arranged to not be fully closed.

Once the material has passed the back pressure control element, the pressure in the material drops. Particularly shorter chained hydrocarbons resulting from cracking evaporate into a gas phase resulting in a gas containing hydrocarbons.

The material with the liquid and the gas containing hydrocarbons is passed to the separation structure 12. In the separation structure 12, the gas containing hydrocarbons separates from the liquid containing longer chains of hydrocarbons of the material. The gas containing hydrocarbons rises from the liquid. The separation structure 12 releases gas containing hydrocarbons with a chain length equal to or less than a predetermined chain length. In some embodiments the separation structure 12 comprises a gas release at its top portion. The gas release preferably is equipped with the partial condenser 21.

In various embodiments the separation structure 12 comprises a partial condenser 21, a separation zone 25 containing a gas-liquid interface of the hydrocarbon material, and a setting zone 28 for heavy hydrocarbons and/or solid carbon to accumulate. In some embodiments the separation structure 12 comprises a cylinder shaped intermediate portion 24 containing the separation zone 25, and a funnel shaped bottom portion 27 containing the setting zone 28 with the funnel ending in an outlet for the heavy hydrocarbons and/or solid carbons.

The partial condenser 21 is configured to allow gas having hydrocarbons with a maximum chain length to pass. The partial condenser 21 cools the gas containing hydrocarbons to a condensation temperature that causes hydrocarbons of a certain chain length and above to condense. The partial condenser circulates condensed hydrocarbons back towards the liquid. In some embodiments the condensation temperature is between 270° C. and 370° C. In further embodiments the condensation temperature is 320° C.

In some embodiments the partial condenser 21 comprises a condenser vessel 22 providing a flow path for the gas containing hydrocarbons and a cooling tube 23 for a cooling medium such as thermo oil to cool the gas. In some embodiments the cooling tube 23 intersects the condenser vessel 22. In some embodiments the cooling tube extends in meanders, spirals and/or helically inside the condenser vessel 22. In some embodiments the condenser vessel 22 and the cooling tube 23 are configured such that the gas flows in both in a vertical direction and in one ore more horizontal directions. Said differently, the gas cannot pass the partial condenser 21 in a straight line. In some embodiments the cooling tube 23 provides cooling ribs and/or baffles increasing a contact surface with the gas and particularly guiding and/or retarding the gas flow inside the partial condenser 21. In some embodiments the partial condenser 21 comprises a random arrangement of cooling ribs and/or baffles. In some embodiments the cooling tube 23, the cooling ribs and/or the baffles are sloped to guide condensed hydrocarbons away from a main flow of gas, e.g. to the sides of the condenser vessel 22 to either flow or drop back into the liquid.

The partial condenser 21 is thus arranged to pass gas containing hydrocarbons having chain lengths including or below the predetermined chain length. In some embodiments the predetermined chain length is 30 carbons. In further embodiments the predetermined chain length is 25 carbons. In further embodiments the predetermined chain length is 22 or 20 carbons. Hydrocarbons having a chain length above the predetermined chain length are circulated back into the liquid in the separation structure 12.

In various embodiments the separation structure 12 releases the liquid containing hydrocarbons with a chain length longer than the predetermined chain length. The separation structure 12 removes heavy hydrocarbons and/or solid carbon resulting from cracking.

In some embodiments the heating structure 11 comprises a reheating zone 6. The liquid containing hydrocarbons is piped from the separation structure 12 through the reheating zone 6. The reheating zone 6 heats the liquid containing hydrocarbons again such that further long chained hydrocarbons are cracked. In some embodiments the reheating zone is arranged to provide an exposure temperature of not more than 50° C. above the temperature of the liquid containing hydrocarbons. The limited exposure temperature may limit carbonization of the hydrocarbons. In some embodiments the reheating zone 6 is arranged to at least partially account for the heat loss of the material in the separation structure 12 due to the separation of gas and carbons, as well as heat loss through the wall of the separation structure 12 and any pipelines. In some embodiments the reheating zone 6 provides an exposure temperature of between 380° C. and 450° C. In further embodiments the reheating zone 6 provides an exposure temperature of between 390° C. and 410° C.

In some embodiments the liquid containing hydrocarbons passes a filter 9 to remove particles. In some embodiments the liquid containing hydrocarbons is forwarded by means of a pump 10 arranged to adjust a flow rate of the liquid.

The liquid exits the reheating zone 6 and evaporates gas of cracked hydrocarbon chains. In some embodiments the liquid in the reheating zone 6 is not pressurized such that some of the cracked hydrocarbons evaporates into gas of cracked hydrocarbon chains in the reheating zone 6 already. In some embodiments the liquid and/or gas exiting the reheating zone 6 is feed into the separation structure 12 to release the evaporated gas. In some embodiments the liquid and/or gas exiting the reheating zone 6 is mixed with the material exiting the heating zone 1, 2, 3, 4. In some embodiments the liquid and/or gas exiting the reheating zone 6 is mixed with the material exiting the back pressure control element 5*a*, 5*b*. In some embodiments a mixing ratio of liquid and/or gas exiting the reheating zone 6 to material exiting the heating zone 1, 2, 3, 4 is between 5:1 and 15:1 by flow rate, more preferably between 8:1 and 10:1 by flow rate. In some embodiments the mixing ratio is adjusted by the feeding device 7, the heating zone, the back pressure control element and the pump 10. In some embodiments the reheating zone 6 is supplied with thermo oil such as the thermo oil used in the first to fourth heating sections 1, 2, 3, 4. In some embodiments the reheating zone 6 receives thermo oil of the same temperature as the fourth heating zone 4.

In some embodiments, the reheating zone 6 adjusts a temperature of the material dependent on a volume of the material inside the separation structure 12. In some embodiments the reheating zone adjusts a temperature of the material to adjust a cracking rate of the material. In some embodiments the cracking rate is a measure for cracking events per time frame. In further embodiments the cracking rate is a measure of cracking events per volume. By adjusting the cracking rate, the amount of short chained hydrocarbons in the material is adjusted which in turn adjusts evaporation of the material, as cracked hydrocarbons generally have a lower evaporation temperature than the same hydrocarbons before cracking. Further, by heating the material, more material evaporates. Accordingly, by increasing the temperature of the material, evaporation in the material is promoted and the volume of the material in the liquid state decreases. In some embodiments this is used to adjust the level of the material in the liquid state inside the separation structure 12.

In an exemplary embodiment, the heating sections 1, 2, 3, 4, the reheating zone 6 and the thermal oil used provide the following parameters:

| Operating temperatures heat exchangers | | | | | |
|---|---|---|---|---|---|
| | heating section 1 | heating section 2 | heating section 3 | heating section 4 | reheating zone 6 |
| PM Inlet Temp ° C. | 250 | 295 | 330 | 368 | 395 . . . 408 |
| PM Outlet Temp ° C. | 300 | 333 | 368 | 398 | 415 . . . 425 |
| TO Inlet Temp ° C. | 313 | 350 | 380 | 393 | 415 . . . 425 |
| TO Outlet Temp ° C. | 300 | 340 | 374 | 400 | 410 . . . 420 |

where "PM Inlet Temp" designates the temperature of the material containing long chained hydrocarbons when input into the respective heating section, "PM Outlet Temp" designates the temperature of the material containing long chained hydrocarbons when output from the respective heating section, "TO Inlet Temp" designates the temperature of the thermal oil used as a heating medium in this exemplary embodiment when applied to the respective heating section and "TO Outlet Temp" designates the temperature of the thermal oil after application in the respective heating zone. As can be seen in this table, a maximum difference between TO Inlet Temp and PM Outlet Temp as well as between TO Outlet Temp and PM Inlet Temp does not exceed 50° C. As the thermal oil flows in a direction opposite to a flow direction of the material through the respective heating section, the exposure temperatures do not exceed 50° C. above the temperature of the material.

In various embodiments the material containing hydrocarbons comes from the heating structure 11 and enters the separation structure 12 through an inlet 26. In some embodiments the inlet is configured to forward the material tangentially into the separation zone 25. Said differently, the material flows into the cylinder shaped intermediate portion 24 offset from a vertical axis of the cylinder shaped intermediate portion 24. Accordingly, the liquid inside the intermediate portion is caused to spin. Heavy hydrocarbons and/or solid carbons move towards the outside of the separation zone 25. At the outside the heavy hydrocarbons and/or solid carbons experience friction with sidewalls of the separation zone 25, such as the inner wall of the cylinder shaped intermediate portion 24. The heavy hydrocarbons and/or solid carbons decelerate and sink towards the bottom. In various embodiments, the heavy hydrocarbons and solid carbons accumulate in the setting zone 28. In some embodiments the funnel shaped bottom portion 27 guides the heavy hydrocarbons and solid carbons to the outlet for the heavy hydrocarbons and/or solid carbons.

In various embodiments the setting zone 28 comprises a separating cone 29 arranged above the funnel shaped bottom portion 27. The separating cone 29 comprises a sheet forming a lateral cone surface with the cone base facing the bottom portion 27 and the cone top facing the top portion of the separation structure 12. In various embodiments the separating cone 29 is essentially formed as a right circular cone having its apex adjacent or coincident with the vertical axis of the cylinder shaped intermediate portion 24. In various embodiments the separating cone 29 has a truncated form and comprises an opening at the apex. The separating cone 29 is arranged such that there remains a gap between the separating cone 29 and the inner wall of the cylinder shaped intermediate portion 24 and/or the funnel shaped bottom portion 27 such that solid carbons and/or the heavy hydrocarbons can pass to the outlet. The gap preferably is arranged around the circumference of the separating cone 29. The separating cone 29 inhibits that the spinning liquid in the intermediate portion 24 agitates the accumulated heavy hydrocarbons and/or solid carbons in the funnel shaped bottom portion 27. This allows the heavy hydrocarbons and/or solid carbons to pack more densely at the outlet and can be removed with less liquid hydrocarbons.

In various embodiments the heavy hydrocarbons and/or solid carbons are released via a valve structure 13 configured to adjust a fill level in the separation structure 12 at least stays at a predetermined minimum level. In various embodiments the valve structure 13 comprises at least first and second lock valves 31, 32 of which at least one is usually closed during operation and a lock chamber between the first and the second lock valve 31, 32. In some embodiments a control element 33 controls the lock valves 31, 32. During operation the first lock valve 31 adjacent to the bottom portion 27 is open and allows heavy hydrocarbons and/or solid carbons to exit the separation structure 12. The heavy hydrocarbons and/or solid carbons enter the lock chamber. Before the heavy hydrocarbons and/or solid carbons are released, the first lock valve 31 is closed. Then, the second lock valve 32 is opened.

Figure 2:
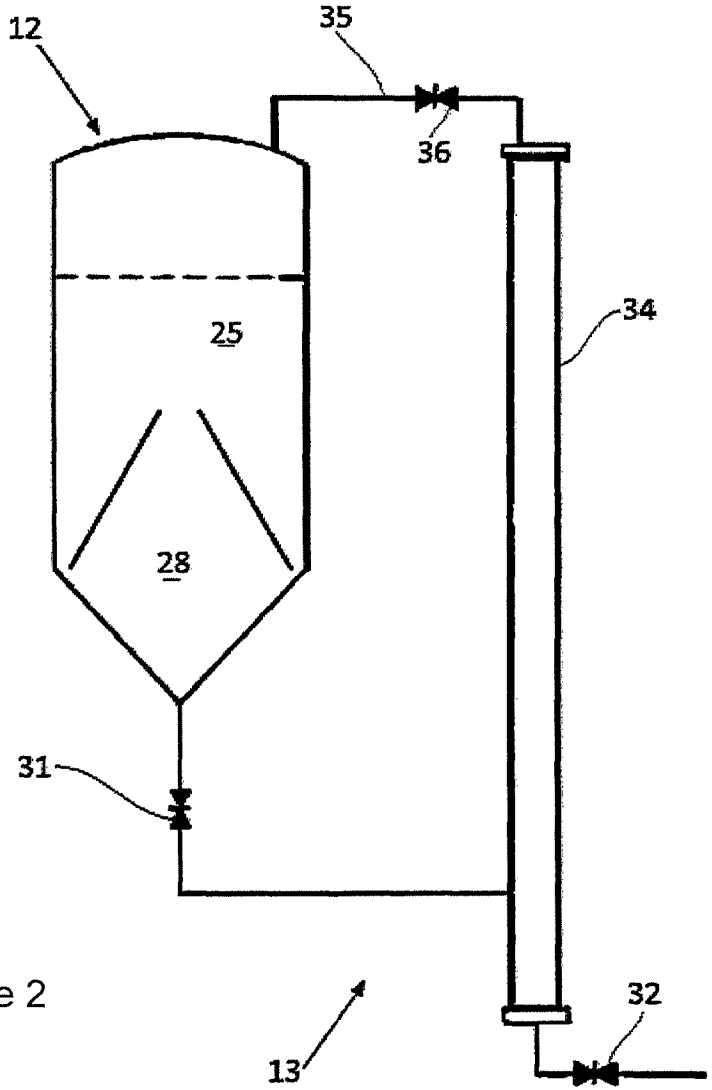
FIG. 2 shows an embodiment of a separation structure and a release structure.

FIG. 2 shows an embodiment of the separation structure 12 and the valve structure 13. The valve structure 13 of FIG. 2 comprises the first lock valve 31, the lock chamber 34, the second lock valve 32 and a compensation line 35. The compensation line comprises a compensation valve 36. The lock chamber 34 is arranged to extend between similar height levels as the separation zone 25 and the setting zone 28. The compensation line 35 via the compensation valve 36 allows subjecting the separation structure 12 and the lock chamber 34 to the same fluid pressure at their top portions allowing the lock chamber 34 to fill under the pressure from the liquid inside the separation structure.

When operating the separation structure 12, it is advantageous to always have a certain level of liquid inside the separation structure 12. As long as the first lock valve 31 and the compensation valve 36 are open and the second lock valve 32 is closed, a fill level of the lock chamber 34 corresponds to the fill level of the separation structure 12. As the heavy hydrocarbons and/or solid carbons accumulate in the setting zone 28, the heavy hydrocarbons and/or solid carbons are flushed out of the separation structure 12 into the lock chamber 34. As the fill level in the lock chamber corresponds the fill level in the separation structure 12, the capacity of the lock chamber 34 increases with increasing fill levels. However, when the fill level of the separation structure 12 is low, the capacity of the lock chamber 34 is low such that the separation structure is not fully drained into the lock chamber 34 and thus does not run empty. When the lock chamber 34 is filled, the first lock valve 31 and the compensation valve 36 are closed. The second lock valve 32 is opened. In various embodiments the lock chamber 34 is pressurized with an inert gas to drive out the heavy hydrocarbons and/or solid carbons. When the lock chamber 34 is emptied, the second lock valve 32 is closed, and the first lock valve 31 and the compensation valve 36 are opened. Further heavy hydrocarbons and/or solid carbons from the setting zone 28 is allowed to enter the lock chamber 34.

In various embodiments the heavy hydrocarbons and/or solid carbons in the lock chamber 34 are above their ignition temperature. The heavy hydrocarbons and/or solid carbons thus may be cooled prior to contacting air. In some embodiments the heavy hydrocarbons and/or solid carbons are thus fed into a cooling chamber to be cooled prior to being released. In some embodiments the heavy hydrocarbons and/or solid carbons exit the cooling chamber after their temperature has dropped below a certain maximum temperature. In some embodiments the maximum temperature for the heavy hydrocarbons and/or solid carbons is an ignition temperature.

The invention claimed is:

1. A method for breaking down long chained hydrocarbons, having a chain length greater than 20 carbons, from plastic-containing waste and organic liquids based on crude oil, comprising:

providing material containing long-chained hydrocarbons;

heating a specific volume of the material containing long-chained hydrocarbons to a cracking temperature, at which cracking temperature the chains of hydrocarbons in the material start cracking into shorter chains; and for the specific volume having a temperature above the cracking temperature, exposing the specific volume to heat which is less than or equal to 50° C. above the temperature of the specific volume;

wherein, the method further comprises, while exposing, adjusting a pressure of the specific volume to limit a gas content.

2. The method of claim 1, while exposing, adjusting the pressure of the specific volume at between 10 and 35 bar.

3. The method of claim 1, wherein an additive is provided while heating the specific volume until it is sufficiently flowable, the additive being an antioxidant particularly provided to donate a hydride to a chain end after cracking a long-chained polymer.

4. The method of claim 1, further comprising lowering a pressure of the specific volume after having exposed the specific volume to heat.

5. The method of claim 1, further comprising after having exposed the specific volume to heat, adjusting a temperature of the specific volume to adjust gas evaporating from the specific volume.

6. The method of claim 5, wherein the temperature is adjusted by cooling the specific volume.

7. The method of claim 5, wherein evaporated gas contacts a partial condenser, the partial condenser being configured to separate long-chained hydrocarbons from the gas.

8. The method of claim 5, wherein the specific volume after having evaporated gas is reheated to crack remaining long-chained hydrocarbons, and wherein the reheated specific volume is mixed with further material having been exposed to heat for the first time.

9. The method of claim 1, further comprising separating coke from the specific volume after having exposed the specific volume to heat.

10. The method of claim 1, wherein the specific volume after having been exposed to heat enters a separator vessel, where gas evaporates, and coke is separated via an outlet structure, the outlet structure preferably maintaining a minimum level of liquid material inside the separator vessel while having an opening of the separator tank to the outlet structure below the minimum level of liquid material.

11. The method of claim 10 wherein the outlet structure comprises a lock either opening towards the separator vessel to separate coke or blocking the outlet structure from the separator vessel to release the coke in the lock.

12. The method of claim 10 wherein the outlet structure comprises a valve and a cooling structure maintaining the minimum level of liquid material inside the separator vessel and releasing the coke once the coke temperature has dropped below its combustion temperature.

13. The method of claim 10, wherein the separator vessel provides a setting zone adjacent to the opening of the separator tank to the outlet structure.

14. A method for breaking down long chained hydrocarbons, having a chain length greater than 20 carbons, from plastic-containing waste and organic liquids based on crude oil, comprising:

providing material containing long-chained hydrocarbons;

heating a specific volume of the material containing long-chained hydrocarbons to a cracking temperature, at which cracking temperature the chains of hydrocarbons in the material start cracking into shorter chains; and for the specific volume having a temperature above the cracking temperature, exposing the specific volume to heat which is less than or equal to 50° C. above the temperature of the specific volume;

wherein an additive is provided while heating the specific volume until it is sufficiently flowable, the additive being an antioxidant particularly provided to donate a hydride to a chain end after cracking a long-chained polymer, the additive preferably containing butylated hydroxytoluene (BHT) and/or zeolite.

15. A method for breaking down long chained hydrocarbons, having a chain length greater than 20 carbons, from plastic-containing waste and organic liquids based on crude oil, comprising:

providing material containing long-chained hydrocarbons;

heating a specific volume of the material containing long-chained hydrocarbons to a cracking temperature, at which cracking temperature the chains of hydrocarbons in the material start cracking into shorter chains; and for the specific volume having a temperature above the cracking temperature, exposing the specific volume to heat which is less than or equal to 50° C. above the temperature of the specific volume;

wherein the specific volume after having been exposed to heat enters a separator vessel, where gas evaporates preferably via a partial condenser, and coke is separated via an outlet structure, the outlet structure preferably maintaining a minimum level of liquid material inside the separator vessel while having an opening of the separator tank to the outlet structure below the minimum level of liquid material.

16. The method of claim 15 wherein the outlet structure comprises a lock either opening towards the separator vessel to separate coke or blocking the outlet structure from the separator vessel to release the coke in the lock.

17. The method of claim 15 wherein the outlet structure comprises a valve and a cooling structure maintaining the minimum level of liquid material inside the separator vessel and releasing the coke once the coke temperature has dropped below its combustion temperature.

18. The method of claim 15, wherein the separator vessel provides a setting zone adjacent to the opening of the separator tank to the outlet structure.

* * * * *